US005425163A

United States Patent [19]

Von Braun et al.

[11] Patent Number: 5,425,163

[45] Date of Patent: Jun. 20, 1995

[54] MULTI-FUNCTIONAL CREMATION CONTAINER FOR A CADAVER

[76] Inventors: Raymond M. Von Braun; Robert V. Milby, both of 906 W. Victoria Ave., #178, Montebello, Calif. 90640

[21] Appl. No.: 69,980

[22] Filed: May 28, 1993

[51] Int. Cl.[6] ..... A61G 17/00

[52] U.S. Cl. ..... 27/7; 27/14; 27/35; 428/913

[58] Field of Search ..... 27/35, 10, 2, 7, 14, 27/17, DIG. 1; 428/913

[56] References Cited

U.S. PATENT DOCUMENTS

| | | | |
|---|---|---|---|
| 749,763 | 1/1904 | Warner . | |
| 1,234,180 | 7/1917 | Kersten . | |
| 1,348,579 | 8/1920 | Post et al. . | |
| 1,507,957 | 9/1924 | Edwards . | |
| 1,705,410 | 3/1929 | Laidlaw | 27/35 |
| 1,727,242 | 9/1929 | McKee | 27/35 |
| 1,730,666 | 10/1929 | Listing . | |
| 2,004,454 | 6/1935 | Wilson | 27/35 |
| 2,156,552 | 5/1939 | Taylor | 27/3 |
| 2,327,949 | 8/1943 | West | 27/3 |
| 2,448,923 | 9/1948 | Skolnik | 27/3 |
| 2,527,464 | 10/1950 | Titmus | 27/7 |
| 2,579,756 | 12/1951 | Reed | 27/7 |
| 2,617,171 | 11/1952 | Kimmel | 27/7 |
| 3,164,880 | 1/1965 | Hotchkiss | 27/17 |
| 3,367,004 | 2/1965 | Schneider | 27/3 |
| 3,470,593 | 10/1969 | Baron | 27/7 |
| 3,545,055 | 12/1970 | Pare | 27/7 |
| 3,868,799 | 3/1975 | Hayward | 27/2 X |
| 3,997,948 | 12/1976 | Hicks | 27/7 X |
| 4,253,220 | 3/1981 | Work | 27/7 X |
| 4,407,053 | 10/1983 | Ball | 27/14 |
| 4,607,417 | 8/1986 | Hancovsky | 27/1 |
| 4,780,940 | 11/1988 | Jay | 27/28 |

FOREIGN PATENT DOCUMENTS

| | | | |
|---|---|---|---|
| 1331992 | 6/1963 | France | 27/7 |
| 6510367 | 2/1966 | Netherlands | 27/7 |

*Primary Examiner*—Carl D. Friedman
*Assistant Examiner*—Beth A. Aubrey

[57] ABSTRACT

A multi-functional cremation container for a cadaver is provided. A rectangular container is enclosed on five sides by four container side panels and a bottom panel. The sixth side is an upwardly facing open top for providing access to the internal volume within the container. The side panels terminate at the open top in a first annular horizontal peripheral groove and a downturned external flange having a downfacing annular edge. Each side is sloped so as to allow multiple cremation containers to be nestled for compact storage and easy transportation. A rectangular cover has a horizontal top panel with four peripheral, downwardly extending cover side panels. The cover side panels fit over the container flange for closing the container, and include formed therein a plurality of reliefs for carrying the casket. The top panel has a peripheral upwardly facing second annular horizontal groove for nesting within the first annular groove as a moisture barrier. Each of the cover side panels includes a latching rib for fitting against the downfacing annular edge of the flange of the container. Both the cover and the container are manufactured from a material that produces no atmospheric polluting gases or vapors when burned.

12 Claims, 2 Drawing Sheets

MULTI-FUNCTIONAL CREMATION CONTAINER FOR A CADAVER

FIELD OF THE INVENTION

This invention relates to a casket for the transport, storage and cremation of a cadaver, and, more particularly, to such a casket having certain improvements in use and especially in providing non-polluting combustion byproducts.

BACKGROUND OF THE INVENTION

Considerable handling of a corpse is required prior to final disposition of the body. The corpse must be moved from the site of death, possibly stored for identification and mounted for autopsy, moved to a funeral preparation site, mounted again for funeral preparation, moved again to the funeral site, handled in preparing the corpse for the funeral, with possible viewing, and then finally moved to the site for final disposition. In all of the moving and handling, the body and body substances may be exposed to a number of people, both in line of professional services and mourners. It has long been known that the deceased continue to carry the diseases of the cause of death as well as those incidental to such cause, and that these diseases may be highly contagious during the period of time from the moment of death to the final disposition of the body. Today, more then ever, it has become most imperative to treat the deceased with a great deal of care in avoiding the spread of infection. There is a great need for a cremation container for the deceased that is able to contain the corpse and fluids expelled therefrom in such a manner that the spread of infection is totally avoided.

Additionally, there is a need for an inexpensive body cremation container which is at once strong, impermeable, durable, easily stored and shipped in quantity and which is burned without producing residues and pollutants.

The relevant prior art includes a variety of burial and other cremation container having features of interest and which are made of a great variety of materials. For example, Edwards, U.S. Pat. No. 1,507,957 discloses a cremation container composition made of rice, straw, paper, wood pulp and water. Post and Kersten, U.S. Pat. No. 1,348,579 and U.S. Pat. No. 1,234,180 respectively, disclose cremation container compositions of paper. Listing U.S. Pat. No. 1,730,666 shows a mortar-like, cementitious composition. Wilson in U.S. Pat. No. 2,004,454 discloses a fiber outer layer with an asphaltum inner layer. Warner, Taylor, West and Skolnik disclose compressed paper, asphalt over plywood, an asphalt lamination and pitch impregnated paper respectively in U.S. Pat. Nos. 749,763, 2,156,552, 2,327,949, and 2,448,923 respectively.

Some of the prior art materials are highly flammable and do burn with little residue or pollutants. Some of the prior art materials are strong or have other attributes such as compactness or light weight. None of the prior art discloses or claims a cremation container for the intended use which is at once a pathogen barrier and yet provides the other important advantages of the instant invention.

SUMMARY OF THE INVENTION

The present invention is a multi-functional cremation container for a cadaver. A rectangular container is enclosed on five sides by four container side panels and a bottom panel. The sixth side is an upwardly facing open top for providing access to the internal volume within the container. The side panels terminate at the open top in a first annular horizontal peripheral groove and a downturned external flange having a downfacing annular edge. Each side is sloped so as to allow multiple caskets to be nestled for compact storage and easy transportation. A rectangular cover has a horizontal top panel with four peripheral, downwardly extending cover side panels. The cover side panels fit over the container flange for closing the container. The top panel has a peripheral upwardly facing second annular horizontal groove for nesting within the first annular groove as a moisture barrier. One portion of the cover may be transparent for viewing the contents of the container. Each of the cover side panels includes a latching rib for fitting against the downfacing annular edge of the flange of the container. Both the cover and the container are manufactured from a material that produces no atmospheric polluting gases or vapors when burned.

The present invention is a multi-functional cremation container that is able to contain a corpse as well as the fluids and noxious vapors expelled from the corpse. The present invention is inexpensive to produce, and is at once strong, impermeable, durable, easily stored and shipped in quantity, and is burned without producing residues and pollutants. Further, the present invention may be built of a size to fit into a standard display casket so that the cadaver does not need to be removed from the present invention at all. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
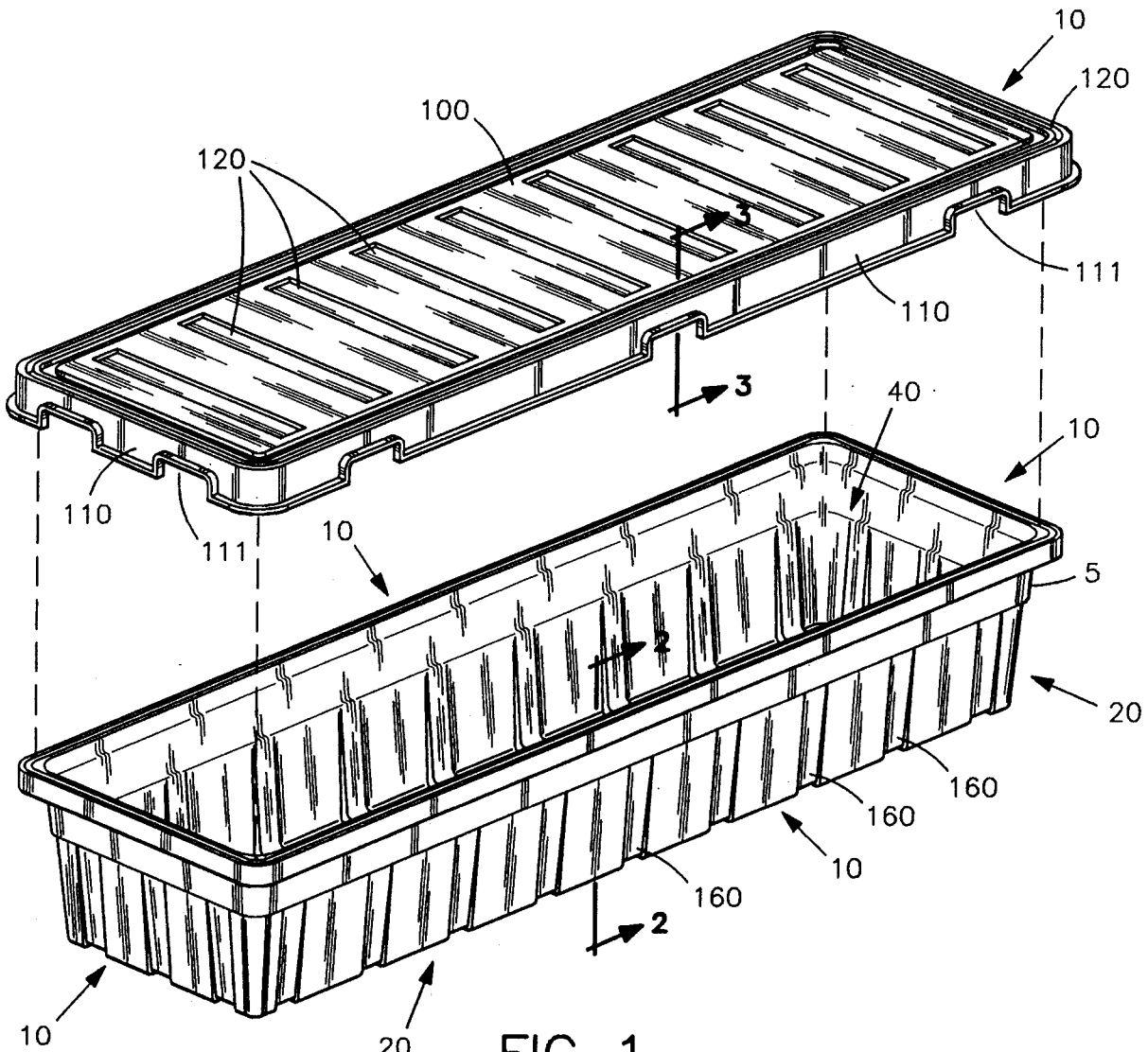
FIG. 1 is an exploded perspective illustration of the invention, illustrating a container and a cover of the invention.

FIG. 1 shows a multi-functional cremation container 5 for a cadaver. A rectangular container 8 is enclosed on five sides by four container side panels 10 and a bottom panel 20. The sixth side is an upwardly facing open top 40 for providing access to an internal volume 30 within the container 8. The side panels 10 terminate at the open top 40 in a first annular horizontal peripheral groove 50 and a downturned external flange 60 having a downfacing annular edge 70. The flange 60 defines an annular hand clearance space 80 between the flange 60 and the side panels 10 for improved gripping in carrying the container 8. Further, the side panels 10 are sloped (FIG. 2) such that multiple containers 8 may be nestled together for compact storage thereof.

A rectangular cover 90 has a horizontal top panel 100 with four peripheral, downwardly extending cover side panels 110. The side panels 110 fit over the container flange 60 for closing the container 8. The top panel 100 has a peripheral upwardly facing second annular horizontal groove 120 for nesting within the first annular groove 50 as a moisture barrier. In one embodiment of the invention, at least one portion 91 of the cover 90 is transparent for viewing the contents of the container 8. Further, a plurality of notch-shaped reliefs 111 may be included in the cover side panels 110 for facilitating carrying of the casket 5 when the cover 90 is in place on the container 8.

In one embodiment of the invention, the four cover side panels 110 and the annular downturned external flange 60 are not mutually flush when the cover 90 is placed on the container 8, thereby allowing the cover 90 to be more easily removed from the container 8. Such a non-flush condition may be achieved by the relative downward angle of each of the four cover side panels 110 and the relative downward angle of the external flange 60 being unequal (FIG. 3).

In the preferred embodiment of the invention, each of the cover side panels 110 includes a latching means 150, such as a raised rib portion (FIG. 3), for fitting against the downfacing annular edge 70 of the flange 60 of the container 8. As such, to remove the cover 90 each cover side panel 110 must be pulled outwardly until the flange 60 of the container disengages the latching means 150 of each cover side panel. Lifting the casket 5 by the notch-shaped reliefs 111 does not pull the side panels 110 away from the container 8 enough to disengage the latching means 150. Further, the container 8 includes a plurality of parallel container stiffening ribs 160 extending laterally and longitudinally over the container side panels 10 and bottom panel 20 for improved casket rigidity. Likewise, the cover 90 preferably includes a plurality of parallel cover stiffening ribs 170 extending laterally the top panel 100 for improved casket rigidity.

Both the cover 90 and the container 8 are manufactured from a material that produces no atmospheric polluting gases or vapors when burned. Such a material might include polyolefins, polyallomers, polyethylenes, and polypropylenes.

Figure 2:
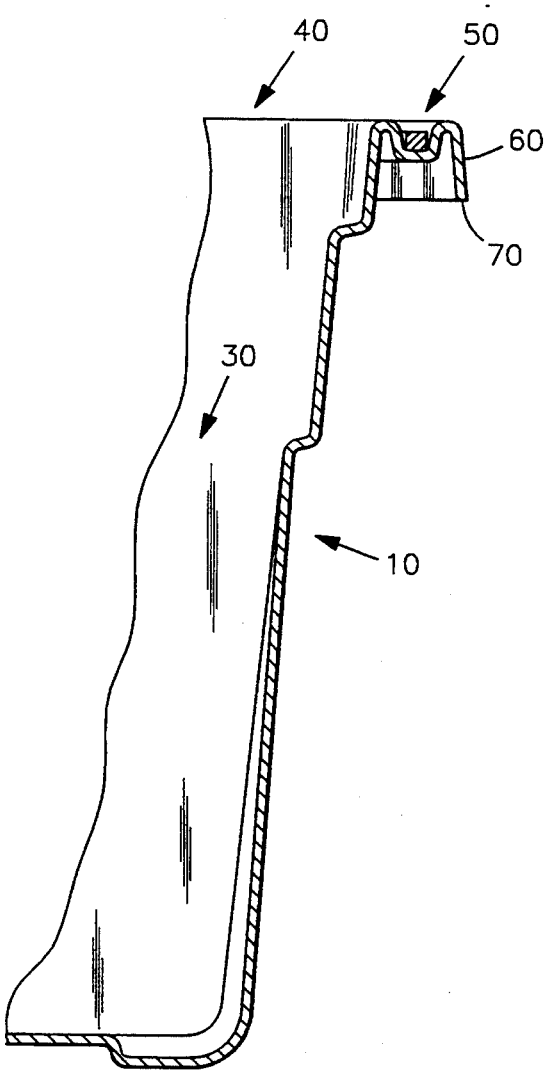
FIG. 2 is a cross-sectional view of the invention, taken generally along lines 2—2 of FIG. 1, illustrating a sloped side panel of the container of the invention.
Figure 3:
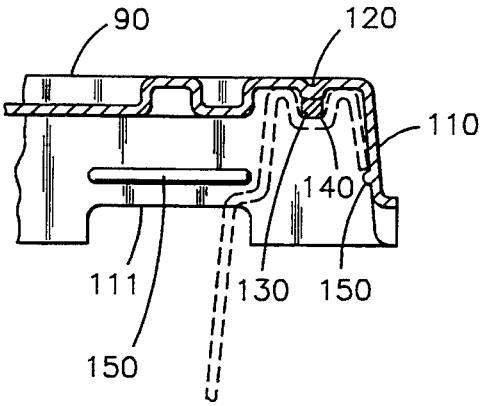
FIG. 3 is a cross-sectional view of the invention, taken generally along lines 3—3 of FIG. 1, illustrating a handhold and a latching rib of the cover of the invention.

A sealing strip 130 may be sandwiched between the first annular groove 50 and the second annular groove 120 for providing a moisture and vapor barrier such that molecular exchange between the internal volume 30 and the environment is thwarted (FIGS. 2 & 3). Such a sealing strip 130 may be manufactured from an ethylene vinyl acetate polyolefin material. Alternatively, such a sealing strip 130 may be manufactured from an Elvax TM material manufactured by DuPont Corporation. The sealing strip 130 preferably includes an adhesive material 140 between the strip 130 and the first annular groove 50 for holding the strip 130 permanently to the container 8. In one embodiment of the invention, the sealing strip 130 may include the adhesive material 140 between the strip 130 and the second annular groove 120 for improved sealing of the cremation container 5.

Figure 4:
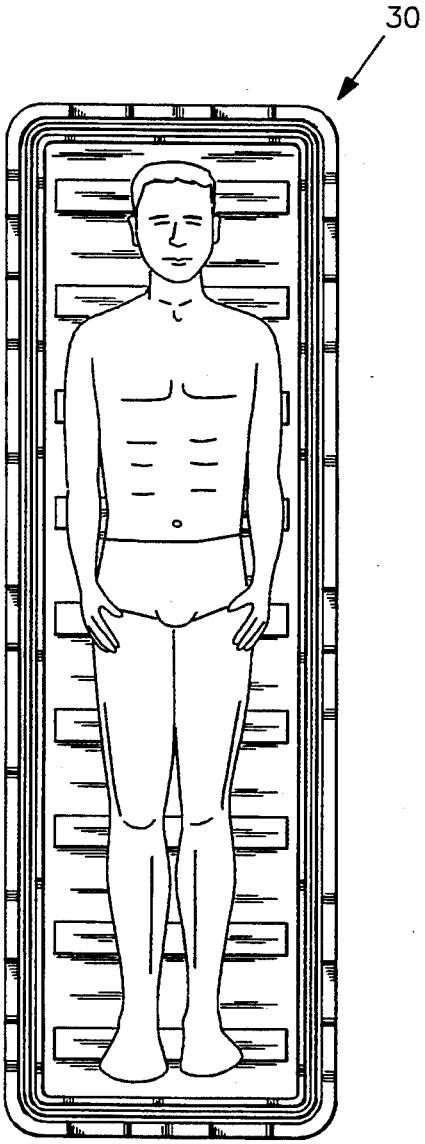
FIG. 4 is a top plan view of the invention, illustrating a cadaver in the internal volume of the container of the invention.

In use, a cadaver can be transported, contained during funeral preparations (FIG. 4), presented at a funeral, and cremated in the cremation container 5 without being removed from the cremation container 5. The cover 90 provides isolation to the internal volume 30 and rigidity to the cremation container 5. Further, the cover 90 may be inverted and placed on the container 8 such that the cover 90 provides a working surface with a raised lip formed from the four cover side panels 110 (not shown). As such, embalming fluids and the like are contained within the inverted cover 90 during funeral preparations. Further, when burned, the casket 5 produces no atmospheric polluting gases or vapors.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A multi-functional cremation container for a cadaver comprising:

a rectangular container made of a material taken from a group of polymers such as polyolefins, polyallomers, polyethylenes and polypropylenes, the material producing no atmospheric polluting gases or vapors when burned, the container being enclosed on five sides by four container side panels, and a bottom panel, a sixth side, being an upwardly facing open top, defining, and providing access to an internal volume within the container, the side panels terminating at the open top in a first annular horizontal peripheral groove and a downturned external container flange having a downfacing annular edge, the flange defining an annular hand clearance space between the flange and the side panels for improved gripping in carrying the container; and a rectangular cover having a horizontal top panel with four peripheral, downwardly extending cover side panels, the side panels fitting over the container flange for closing the container, the top panel having a peripheral, upwardly facing second annular horizontal groove for nesting within the first annular groove as a moisture barrier;

whereby, a cadaver can be contained during funeral preparation, presented at a funeral, and cremated in the cremation container, the cover providing isolation to the internal volume and additional rigidity to the cremation container.

2. The cremation container of claim 1 further including a sealing strip sandwiched between the first and second annular grooves for providing a moisture and vapor barrier such that molecular exchange between the internal volume and the environment is thwarted.

3. The cremation container of claim 2 wherein the sealing strip is of an ethylene vinyl acetate polyolefin.

4. The cremation container of claim 2 wherein the sealing strip is of Elvax TM manufactured by DuPont Corporation.

5. The cremation container of claim 2 wherein the sealing strip includes an adhesive material being positioned between the strip and the first annular groove, for holding the strip permanently to the container.

6. The cremation container of claim 5 wherein the sealing strip further includes the adhesive material being positioned between the strip and the second annular groove, for improved sealing of the casket.

7. The cremation container of claim 1 wherein the four cover side panels and the annular downturned external flange are not mutually flush so that the cover is easily removed.

8. The cremation container of claim 7 wherein said non-flush condition is achieved by the relative downward angle of each of the four cover side panels and the relative downward angle of the external flange being unequal.

9. The cremation container of claim 1 wherein each of the cover side panels includes a means for latching against the downfacing annular edge.

10. The cremation container of claim 1 wherein the container includes a plurality of parallel container stiffening ribs extending laterally and longitudinally over the container side panels and the bottom panel for improved cremation container rigidity.

11. The cremation container of claim 1 wherein the cover includes a plurality of parallel cover stiffening ribs extending laterally and longitudinally over the cover side panels and the top panel for improved casket rigidity.

12. The cremation container of claim 1 further including a plurality of notch-shaped reliefs in the cover side panels for use in carrying the cremation container when the cover is in place on the container.

* * * * *